US012540482B2

(12) United States Patent
Withington et al.

(10) Patent No.: US 12,540,482 B2
(45) Date of Patent: Feb. 3, 2026

(54) SLIDE

(71) Applicant: Splinter Works Limited, Bath (GB)

(72) Inventors: Matthew James Withington, Gloucestershire (GB); Miles Hartwell, Bath (GB)

(73) Assignee: Splinter Works Limited, Bath (GB)

( * ) Notice: Subject to any disclaimer, the term of this patent is extended or adjusted under 35 U.S.C. 154(b) by 119 days.

(21) Appl. No.: 18/672,861

(22) Filed: May 23, 2024

(65) Prior Publication Data

US 2024/0392597 A1 Nov. 28, 2024

(30) Foreign Application Priority Data

May 24, 2023 (GB) ..... 2307794

(51) Int. Cl.
*E04H 4/14* (2006.01)

(52) U.S. Cl.
CPC ..... *E04H 4/144* (2013.01)

(58) Field of Classification Search
CPC ..... E04H 4/144
USPC ..... 4/496
See application file for complete search history.

(56) References Cited

U.S. PATENT DOCUMENTS

| | | | | |
|---|---|---|---|---|
| 2,446,905 | A | 8/1948 | Buffum | |
| 4,805,898 | A * | 2/1989 | Jacober | A63G 21/18 472/117 |
| 5,478,281 | A * | 12/1995 | Forton | A63G 21/18 472/117 |
| 5,718,637 | A | 2/1998 | Rodriguezx-Ferre | |
| 6,575,840 | B2 * | 6/2003 | Hagerty | A63G 21/18 472/117 |
| 6,582,315 | B1 * | 6/2003 | Formanski | A63G 21/18 472/117 |
| 6,988,952 | B1 * | 1/2006 | Hagerty | A63G 21/18 472/117 |
| 2020/0398172 | A1 * | 12/2020 | Svendsen | A63G 21/18 |

FOREIGN PATENT DOCUMENTS

| | | |
|---|---|---|
| CN | 201783191 U | 4/2011 |
| GB | 2580156 A | 7/2020 |

OTHER PUBLICATIONS

United Kingdom Intellectual Property Office, Search Report in priority Application No. GB2307794.4, mailed on Oct. 20, 2023.

* cited by examiner

*Primary Examiner* — Huyen D Le
(74) *Attorney, Agent, or Firm* — Kim IP Law Group LLC

(57) ABSTRACT

A slide 10 comprising a chute 12 and an entryway 14. The entryway 14 has a multi-part body. A handrail 28 mechanically attaches the body parts 16, 18 together. The handrail 28 defines a liquid-flow conduit.

18 Claims, 3 Drawing Sheets

SLIDE

The present invention relates to a slide, and particularly to a water slide for a swimming pool. The invention further relates to a swimming pool complex.

Slides can be used to enter a swimming pool. For such slides, it is common for water to be supplied to a chute of the slide so that the user can slide on the chute more easily.

A user needs to be able to access the chute, and so slides typically have an entryway or accessway to the chute. The entryway may be a ladder or stairs. For a user's safety, the entryway should be stable and mechanically secure. This is particularly important if the entryway is a ladder or stairs, since the user may be above the ground in a precarious position when on the entryway.

A slide is typically a large product, since it needs to be of a sufficient height and length for a person to slide down. Slides may be installed in a variety of locations, including in domestic settings. It is therefore desirable for the slide, despite its large size, to be easy to transport and handle. This particularly applies to domestic settings, where access and the ability to provide lifting equipment may be limited, and therefore where installation of large products may be more challenging.

Additionally, the appearance of the slide can be key, particularly when provided in a domestic setting. As such, it can be important to optimise the form and function of the slide as far as possible, in order to provide an efficient and aesthetically appealing design with a clean and strong outline.

The present invention seeks to provide a solution to these problems.

According to a first aspect of the present invention, there is provided a slide comprising: a chute having an entry and an exit; an entryway which extends to the entry of the chute, the entryway being defined by at least a first body part and a second body part, the first and second body parts being components; and at least one handrail for supporting a user when using the entryway, the handrail mechanically attached to the first body part and to the second body part so as to mechanically secure the first and second body parts together, the handrail defining a liquid-flow conduit having a liquid inlet and a liquid outlet.

By providing first and second component body parts, the entryway of the slide can be easier to transport and handle compared to a single piece entryway. The handrail, which is a separate component to the body part, attaches the first and second body parts together. The handrail therefore plays an important role in the structural integrity of the body of the slide, rather than simply being attached to and supported by the body. The handrail and the body parts of the slide can therefore be considered to be mutually supportive of each other.

The liquid-flow conduit allows for water to be provided to the chute to provide a water slide. The liquid outlet may be at or adjacent to an entry of the chute, and may connect with a liquid distribution element, such as water nozzles, to distribute water across the chute.

The handrail thus serves multiple additional functions in the slide, which dispenses with the need for additional separate components. The slide therefore has a more efficient design which helps to provide a cleaner and more aesthetically appealing appearance. Additionally, less material and/or manufacturing may be required to produce the slide, compared to having separate components for each of the functions of the handrail.

The different functions of the handrail also cooperate to provide an even greater beneficial technical effect. Since a separate liquid-flow conduit and separate external fastenings for the first and second body parts are not required, the overall weight of the slide can be reduced. This potentially reduces a strength requirement for the securement of the first and second body parts, which can therefore be accomplished by the handrail. Additionally, since the handrail defines a liquid flow conduit, an outer wall thereof can be cooled by the liquid. This has the result that a stronger but more heat conductive material, such as metal, could be used to form the handrail to attach the first and second body parts, without it becoming overly hot when exposed to the sun outdoors, as per a slide's typical environment. This is important since the handrail is to be touched in its normal use. However, it will be appreciated that less heat conductive materials and non-metals, such as fibre-reinforced plastics, may be used. The handrail may become hot to touch in particular if it has a dark colour, such as black, and/or a matte texture.

Preferably, the entryway may comprise a plurality of steps so that the entryway is a stairway or a ladder. As such, the user can ascend to the entry of the chute via using the steps, and then descend down the chute.

Advantageously, each of the first body part and the second body part of the entryway may comprise a plurality of steps. The first and second body parts are thus significant component parts of the stairway or ladder.

Beneficially, the handrail may comprise or consist of fibre reinforced plastic. This provides a high strength material to secure the attachment of the first and second body parts. Even if the handrail has a dark colour and may be liable to becoming overly hot in use with exposure to the sun, the cooling effect of the liquid flow can prevent this. Thus, the handrail may still effectively perform its function to support a user when grasped.

Additionally, the entryway may include a user path along which the user is movable and by which the user is supportable, each of the first and second body parts defining a portion of the user path. As such, the first and second body parts are significant component parts of the entryway.

Optionally, the entryway may include two sidewalls, the sidewalls being either side of the user path of the entryway, and the first and second body parts each including a portion of each sidewall.

Preferably, the handrail may be mechanically connected to one of the sidewalls. This provides a suitable location at which the handrail can be held.

Beneficially, there may be two handrails, the handrails being either side of the user path of the entryway.

Advantageously, one of the handrails may be connected to one of the sidewalls and the other of the handrails is connected to the other of the sidewalls.

Preferably, the handrail may extend along an entire length of the entryway. As such, the handrail provides support along the length of the entryway, and allows for liquid to be supplied from the ground and to the chute.

In a preferable embodiment, one of the first body part and the second body part may include a protrusion and the other of the first body part and the second body part second body part may include a hole, the protrusion being received in the hole to additionally mechanically secure the first and second body parts together.

Beneficially, the protrusion may be a tongue, and the hole may be a groove.

This may create a stronger mechanical connection than relying on the handrail alone.

Beneficially, the protrusion and hole may not be secured by adhesive. Ideally, adhesive is not required, since the combination of the protrusion and hole and the handrail together provide sufficient mechanical connection to maintain the first and second body parts together. However, in the event that additional connection is required, then adhesive can be considered.

Additionally, each body part may be curved, particularly in a longitudinal extent thereof.

Optionally, the user path of the entryway is curved in a longitudinal extent thereof.

The curve or arch may better transmit compressive loads, such as those caused by a person standing at the top of the slide.

In a preferable embodiment, one of the first and second body parts includes a portion of the chute. As such, the first and second body parts may not only define the entryway.

Advantageously, the first and second body parts may engage each other. This may provide improved securement therebetween.

According to a second aspect of the invention, there is provided a swimming pool complex comprising: a swimming pool; a slide according to a first aspect of the invention, the exit of the chute at or adjacent to the swimming pool; and a water supply connected to the liquid inlet of the liquid-flow conduit.

The invention will now be more particularly described, by way of example only, with reference to the accompanying drawings, in which.

Figure 1:
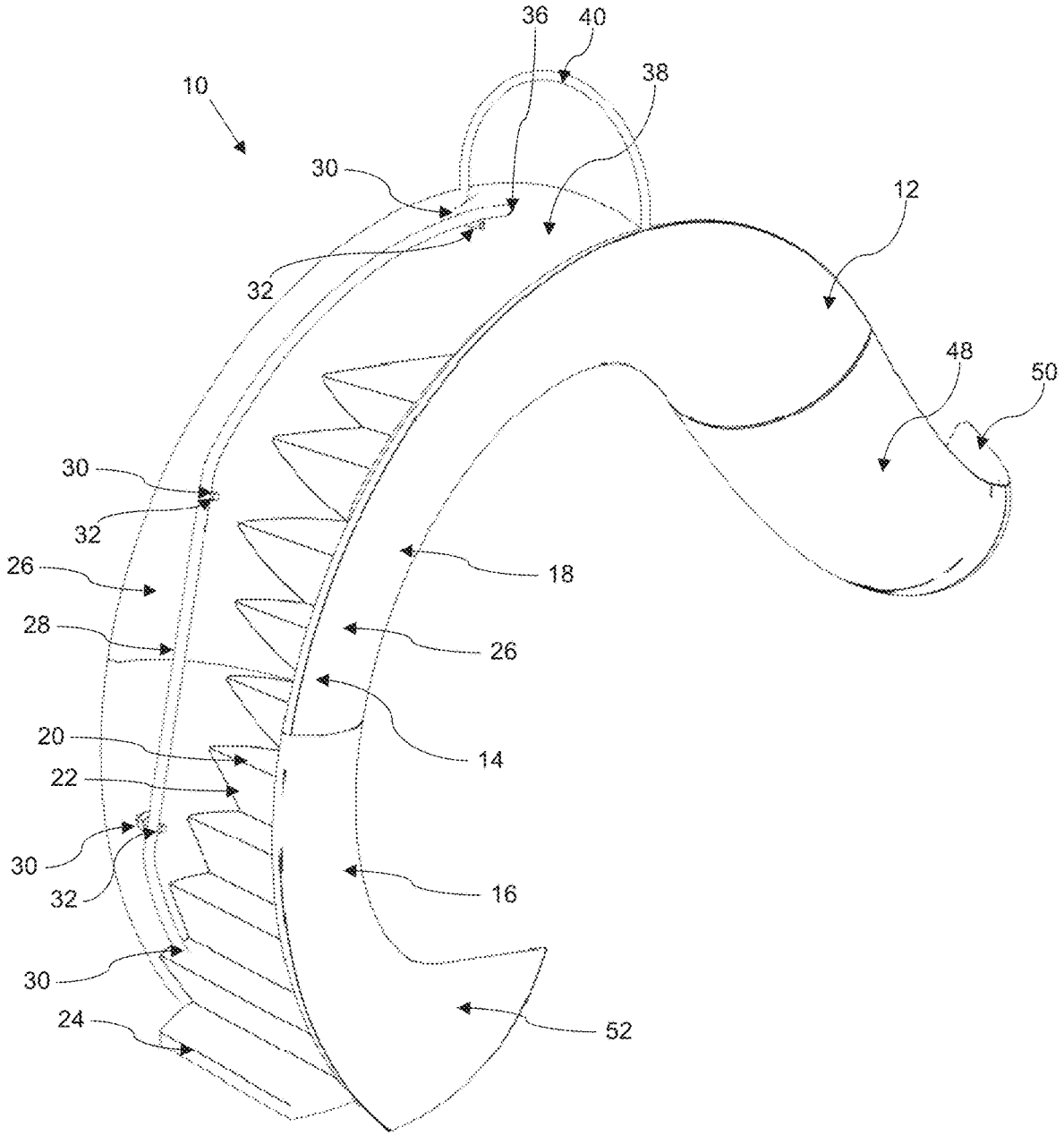
FIG. 1 shows a rear perspective view of a slide in accordance with a first aspect of the invention.
Figure 2:
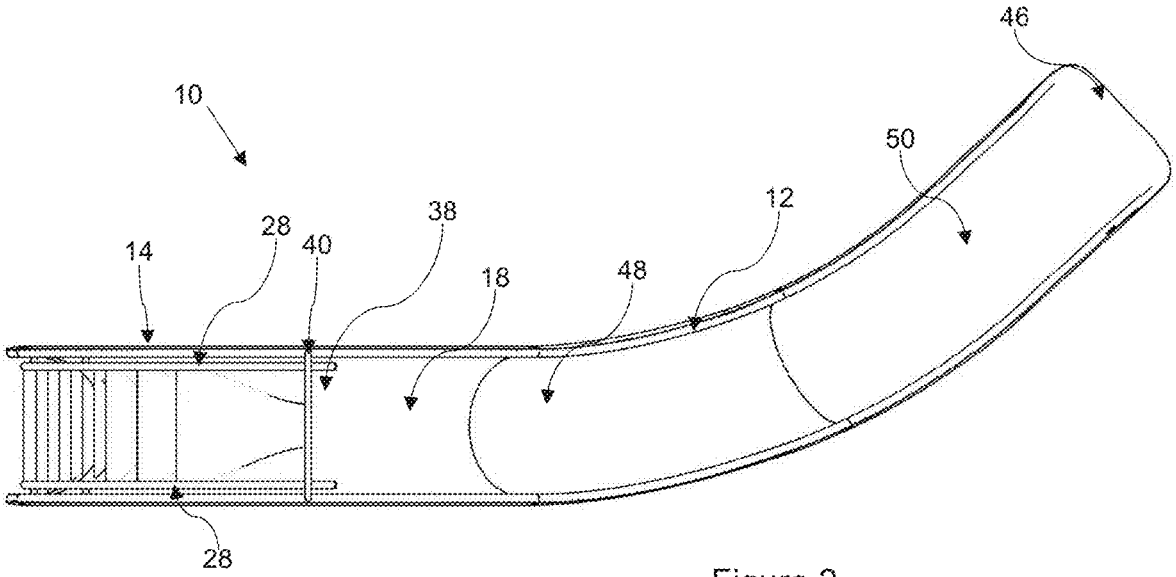
FIG. 2 shows a top view of the slide of FIG. 1.

Referring to FIGS. 1 and 2, a slide 10 is shown having a chute 12 and an entryway 14 or accessway.

The entryway 14 defines a user path for the user to climb, move or walk along to the chute 12 whilst being supported. In other words, the user can use the entryway 14 to access the chute 12. The entryway 14 is defined by multiple parts, including a first body part 16 and a second body part 18. The first and second body parts 16, 18 are components or component parts. In other words, the first and second body parts 16, 18 are separate parts which are brought together to form at least part of the slide 10.

Each of the first and second body parts 16, 18 defines a portion of the user path.

The entryway 14 is here a stairway or staircase having a plurality of steps 20. The steps 20 may here be more particularly described as stairs, since the stairs include risers 22. The risers 22 are here at a non-perpendicular angle to treads of the stairs, and are angled inwardly. The lowermost step 24, may have a recessed riser which is preferably removable or openable to act as an access panel for maintenance and installation purposes.

Each of the first and second body parts 16, 18 may include a plurality of steps 20 or stairs, and preferably all of the steps 20 or stairs of the slide 10 are provided by the first and second body parts 16, 18.

The entryway 14 additionally includes a sidewall 26 either side of the user path, such that there are two sidewalls 26. The sidewalls 26 may be curved, for example. The first and second body parts 16, 18 each define a portion of the sidewalls 26.

As such, preferably, each of the first and second body parts 16, 18 defines a portion of the sidewalls 26 and a number of steps 20.

The first and second body parts 16, 18 are generally of similar size to each other, for example one body part being no more than twice the size of the other body part.

The first body part 16 comprises a lower or distal portion of the entryway 14, and the second body comprises an upper or proximal portion of the entryway 14. The first body part 16 defines an entry for the entryway 14, and may in use start at the ground. A distal or lower end of the first body part 16 engages the ground. Each of the first and second body parts 16, 18 define a portion of the longitudinal extent of the entryway 14.

The second body part 18 here also includes a portion of the chute 12, although not the entire chute, and does not extend to or contact the ground.

An upper or proximal end of the first body part 16 is at or adjacent to a lower or distal end of the second body part 18. Here the two said ends engage each other.

The slide 10 has at least one handrail 28 for supporting the user when using the entryway 14. Here there are two handrails 28, one either side of the user path. Each handrail 28 should be at a suitable height relative to the step for a user to hold with their hand whilst they are on the entryway 14, and needs to be at least in part exposed so that the user can grasp each handrail 28.

Each handrail 28 is mechanically attached to the first body part 16 and is mechanically attached to the second body part 18. This serves to mechanically join the first and second body parts 16, 18 together. The handrail 28 may be attached to the body parts via any joining technique, such as the use of fasteners or welding. Here each handrail 28 is attached to the body parts at distinct points or locations 30. Each handrail 28 may be preferably attached to each first and second body part 16, 18 at at least two spaced apart locations. The handrail 28 may extend into one of the steps 20 at a lower portion of the first body part 16.

The handrail 28 may be attached to each first and second body part 16, 18 via an intermediate component, such as via a protrusion 32 which extends from the sidewall 26 of the entryway 14 to provide clearance between the sidewall 26 and the handrail 28.

Each handrail 28 should be mechanically strong and reliable to ensure a stable connection between the first and second body parts 16, 18. As such, fibre reinforced plastics may be used to form each handrail 28. For example, fibreglass, or carbon fibre may be used. Unreinforced plastics and metals may also be considered. Each handrail 28 may be a single piece, although multi-part formation may be considered. It will be appreciated that other materials may be considered.

The handrail 28 also defines a liquid-flow conduit having a liquid inlet 34 and a liquid outlet 36, the liquid outlet 36 being at or adjacent to an entry 38 of the chute 12. This allows for water to be provided to the chute 12, and therefore the slide 10 can operate as a water slide 10. As such, each handrail 28 may be a continuous tube which allows water to flow therethrough. The handrail 28 should therefore not include open holes or apertures through a sidewall thereof, through which water could leak.

The handrails 28 extend along the entire longitudinal extent of the entryway 14. The liquid inlets 34 of the handrails 28 may connect to a manifold underneath the lowermost step 24 and/or behind an access panel, such as the recessed riser of the lowermost step. As such, the liquid inlet 34 and any associated connections may be obscured from general view and provide a more aesthetically appealing appearance.

Here, both handrails 28 define liquid-flow conduits. However, it will be appreciated that only one handrail 28 might define a liquid-flow conduit with the other handrail 28 not possessing this functionality.

There may be a nozzle at the liquid outlet 36 of the handrails 28 for distributing liquid onto the chute 12.

A grab rail 40 may connect to the two handrails 28 and may extend across and above the entry 38 of the chute 12. The grab rail 40 may be curved, for example being semi-circular or substantially semi-circular. The grab rail 40 may be modified to carry and distribute water across the chute 12.

Figure 3:
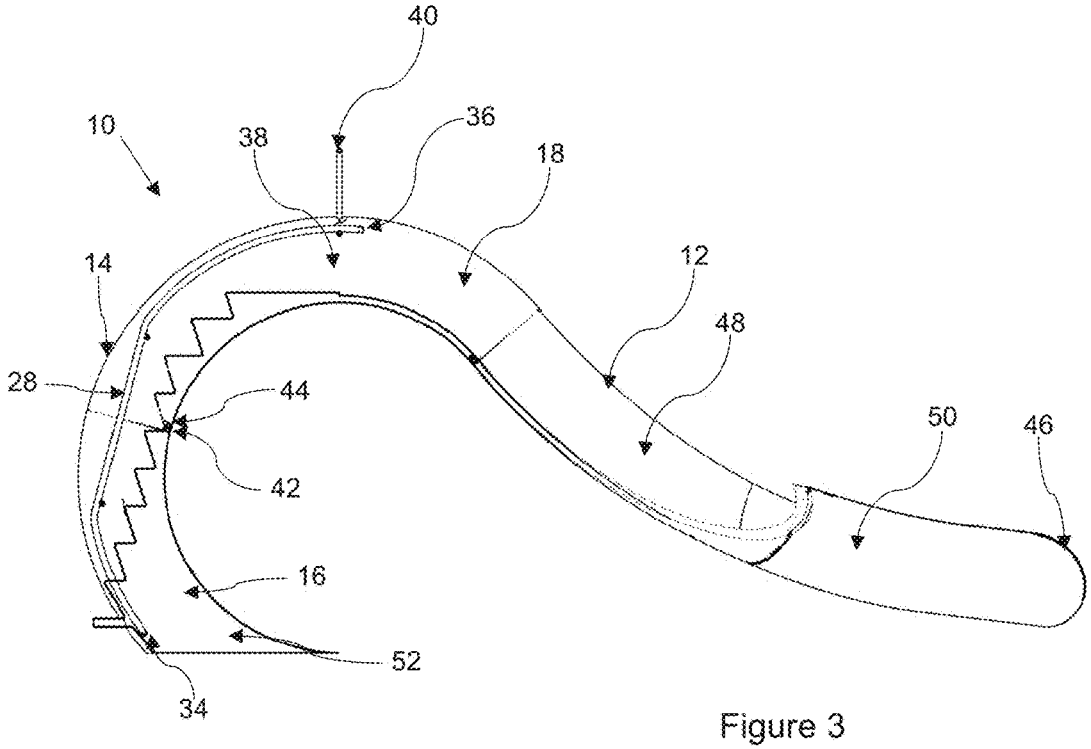
FIG. 3 shows a cross-sectional view of the slide of FIG. 1.
Figure 4:
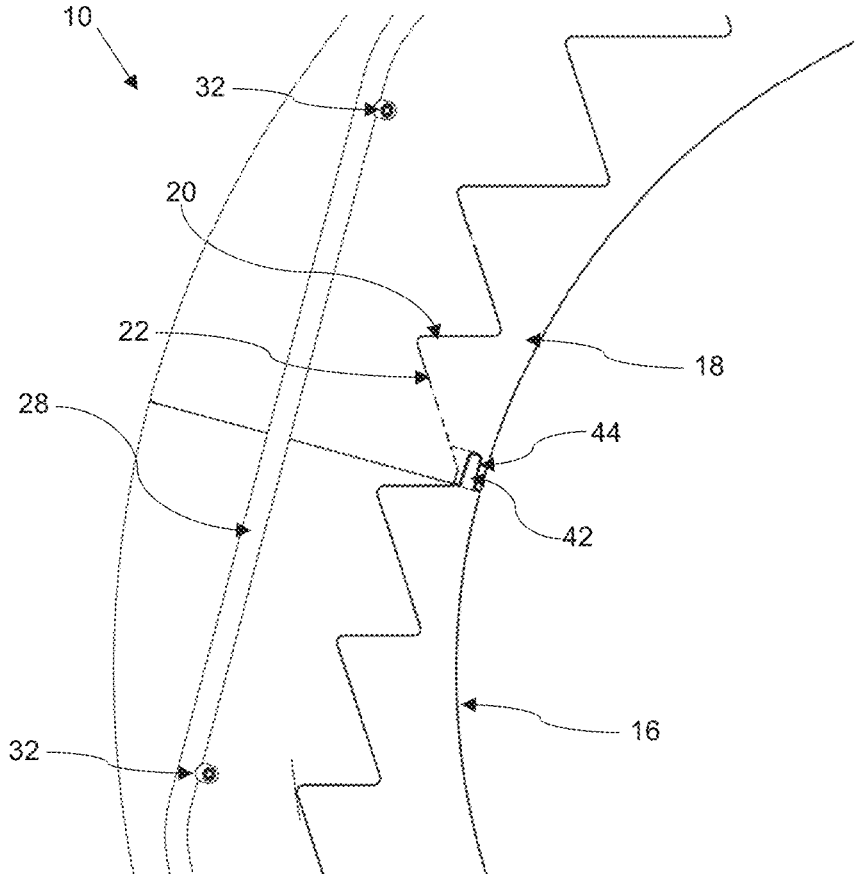
FIG. 4 shows an enlarged view of a portion of the cross-sectional view of FIG. 3.

Referring also to FIGS. 3 and 4, in addition to the mechanical connection between the first and second body parts 16, 18 offered by the handrail 28, preferably the first and second body parts 16, 18 have a further mechanical connection. The further mechanical connection comprises a protrusion 42 on the first body part 16 and a hole 44 on the second body part 18. In particular, the protrusion 42 may be a tongue and the hole 44 may be a groove. It will be appreciated that the protrusion 42 may instead be positioned on the second body part 18, with the hole 44 on the first body part 16. There may be multiple protrusion 42 and hole 44 pairs.

Most preferably, there is no adhesive used to secure the protrusion 42 and the hole 44 together. However, it will be appreciated that adhesive may be used if so desired or required.

At an opposite end to the entry 38 of the chute 12 is an exit 46 of the chute 12. Preferably, a longitudinal extent of the chute 12 between the entry 38 and exit 46 is curved, although it will be appreciated that this may not necessarily be the case.

The chute 12 preferably also has multiple component parts. For example, as mentioned previously, here an upper portion of the chute 12 is defined by the second body part 18. There is also a third intermediate body part 48, and a fourth lower body part 50. Each of the second to fourth body parts 18, 48, 50 define a portion of the longitudinal extent of the chute 12. It will be appreciated that this may not necessarily be the case, and instead the chute 12 may be a single piece. The second body part 18, the third intermediate body part 48, and the fourth lower body part 50 may be interconnected by tongue and groove connectors, for example, or other fixing means.

In use, the component parts of the slide 10 are transported to a swimming pool where the slide 10 is to be installed. The different component parts are assembled and secured to the ground where required. The slide 10 may be secured to the ground via use of a concealed bracket adjacent to the lowermost step 24 and within a fin shaped portion 52 of the first body part 16. The exit of the chute 12 is positioned at the swimming pool. For the first and second body parts 16, 18, the second body part 18 may first be connected to the first body part 16 via the tongue and groove connectors, and then the handrails 28 secured in place to mechanically secure the first and second body parts 16, 18 together. The liquid inlet 34 of each handrail 28 is connected to a pressurised water source via the manifold to allow water to flow up the handrails 28 to the entry of the chute 12.

In use, a user climbs up the entryway 14, using the handrails 28 for support, and then slides down the chute 12.

It is therefore possible to provide a slide having a stairway or ladder which is in at least two sections. The two sections are mechanically secured together via using at least one handrail, which also serves to supply water to the chute.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

We claim:

1. A slide comprising:

a chute having an entry and an exit;

an entryway which extends to the entry of the chute, the entryway being defined by at least a first body part and a second body part, the first and second body parts being components; and at least one handrail configured to support a user when using the entryway, the handrail mechanically attached to the first body part and to the second body part so as to mechanically secure the first and second body parts together, the handrail defining a liquid-flow conduit having a liquid inlet and a liquid outlet.

2. The slide as claimed in claim 1, wherein the entryway comprises a plurality of steps so that the entryway is at least any one of a stairway or a ladder.

3. The slide as claimed in claim 2, wherein each of the first body part and the second body part of the entryway comprises a plurality of steps.

4. The slide as claimed in claim 1, wherein the handrail comprises fibre reinforced plastic.

5. The slide as claimed in claim 1, wherein the entryway includes a user path along which the user is movable and by which the user is supportable, each of the first and second body parts defining a portion of the user path.

6. The slide as claimed in claim 5, wherein the entryway includes two sidewalls, the sidewalls being either side of the user path of the entryway, and the first and second body parts each including a portion of each sidewall.

7. The slide as claimed in claim 6, wherein the handrail is mechanically connected to one of the sidewalls.

8. The slide as claimed in claim 1, wherein there are two handrails, the handrails being either side of the user path of the entryway.

9. The slide as claimed in claim 7, wherein one of the handrails is connected to one of the sidewalls and the other of the handrails is connected to the other of the sidewalls.

10. The slide as claimed in claim 1, wherein the handrail extends along an entire length of the entryway.

11. The slide as claimed in claim 1, wherein one of the first body part and the second body part includes a protrusion and the other of the first body part and the second body part second body part includes a hole, the protrusion being received in the hole to additionally mechanically secure the first and second body parts together.

12. The slide as claimed in claim 11, wherein the protrusion is a tongue, and the hole is a groove.

13. The slide as claimed in claim 11, wherein the protrusion and hole are not secured by adhesive.

14. The slide as claimed in claim 1, wherein each body part is curved.

15. The slide as claimed in claim 1, wherein the user path of the entryway is curved.

16. The slide as claimed in claim 1, wherein one of the first and second body parts includes a portion of the chute.

17. The slide as claimed in claim 1, wherein the first and second body parts engage each other.

18. A swimming pool complex comprising:

a swimming pool;

a slide as claimed in claim 1, the exit of the chute at the swimming pool; and a water supply connected to the liquid inlet of the liquid-flow conduit.

* * * * *